US008336207B2

(12) United States Patent
Johnson et al.

(10) Patent No.: US 8,336,207 B2
(45) Date of Patent: Dec. 25, 2012

(54) METHODS AND APPARATUS FOR COUPLING CAPACITORS

(75) Inventors: James Ryan Johnson, Fort Wayne, IN (US); Francisco Javier Curiel, Chihuahua (MX)

(73) Assignee: RBC Manufacturing Corporation, Beloit, WI (US)

( * ) Notice: Subject to any disclaimer, the term of this patent is extended or adjusted under 35 U.S.C. 154(b) by 0 days.

(21) Appl. No.: 13/223,792

(22) Filed: Sep. 1, 2011

(65) Prior Publication Data

US 2011/0311371 A1 Dec. 22, 2011

Related U.S. Application Data

(62) Division of application No. 12/045,566, filed on Mar. 10, 2008, now Pat. No. 8,029,290.

(51) Int. Cl.
*B21K 21/00* (2006.01)

(52) U.S. Cl. ..... 29/890.035; 29/592.1; 29/729; 417/1; 361/329; 361/522; 361/541

(58) Field of Classification Search ..... 29/592.1, 29/729; 417/1; 361/329, 522, 541
See application file for complete search history.

(56) References Cited

U.S. PATENT DOCUMENTS 3,921,041 A 11/1975 Stockman
4,028,595 A 6/1977 Stockman
4,263,638 A 4/1981 Stockman
4,312,027 A 1/1982 Stockman
4,326,237 A 4/1982 Markarian et al.
4,352,145 A 9/1982 Stockman
4,894,316 A 1/1990 Hjulstrom
6,014,308 A 1/2000 Stockman
6,201,187 B1 * 3/2001 Burbine ..... 174/60
6,336,262 B1 1/2002 Dalal et al.
7,203,053 B2 4/2007 Stockman
7,365,959 B1 * 4/2008 Ward ..... 361/328
7,619,420 B2 * 11/2009 Stockman ..... 324/663
7,859,801 B2 * 12/2010 Roh et al. ..... 361/22
7,987,593 B1 * 8/2011 Gorst et al. ..... 29/857
8,029,290 B2 * 10/2011 Johnson et al. ..... 439/49
2006/0227495 A1 * 10/2006 Stockman ..... 361/328

OTHER PUBLICATIONS

Notice of Allowance and Fee(s) Due for U.S. Appl. No. 12/045,566 dated Jun. 2, 2011.

* cited by examiner

*Primary Examiner* — Derris Banks
*Assistant Examiner* — Azm Parvez
(74) *Attorney, Agent, or Firm* — Armstrong Teasdale LLP

(57) ABSTRACT

A method for supplying a plurality of capacitance values to a plurality of heating, ventilation, air-conditioning, and refrigeration (HVAC/R) components is provided. The method includes configuring a first set of terminals of a connection device to couple a first capacitor to the connection device and configuring the connection device to couple the first capacitor to at least one of the plurality of HVAC/R components. The method further includes configuring a second set of terminals of the connection device to couple a second capacitor to the connection device and configuring the connection device to selectively couple the second capacitor to at least one of the plurality of HVAC/R components.

4 Claims, 7 Drawing Sheets

METHODS AND APPARATUS FOR COUPLING CAPACITORS

This application is a divisional of U.S. patent application Ser. No. 12/045,566, filed Mar. 10, 2008 titled Methods and Apparatus for Coupling Capacitors and issued as U.S. Pat. No. 8,029,290 on Oct. 4, 2011, which is hereby incorporated by reference in its entirety.

BACKGROUND OF THE INVENTION

A typical HVAC/R system includes a cooling unit having a condenser motor and a compressor motor. Condenser motors and compressor motors are often permanent split-capacitor motors. Capacitors couple the condenser motor and the compressor motor to control circuitry.

After receiving a service call for a non-operational HVAC/R system located at a remote site, a typical troubleshooting tactic used by a service technician is to first replace a capacitor of a non-operational motor since the capacitor is a component that may fail and is relatively inexpensive compared to the control circuitry and the motor. However, given the large variety of motors currently in use in HVAC/R systems, the service technician would need to carry a large inventory of capacitors, sometimes including large, often expensive, multi-capacitance capacitors, to remote sites to ensure possession of the capacitor ratings needed to repair every HVAC/R system in use. Should the service technician not have a needed capacitor ratings in his "on-site" inventory of capacitors, returning to a repair center or electronics store to obtain the correct capacitor is neither efficient nor cost-effective.

The problem of having the necessary parts "on-site" has been accentuated by the wider variety of motors and compressors being used in HVAC/R systems due to rising energy efficiency minimum requirements, which are set by government entities. To ensure efficient and cost effective service of HVAC/R systems in the field, a service technician must carry a large number of replacement components, potentially including multi-capacitance capacitors, to a service site.

BRIEF DESCRIPTION OF THE INVENTION

In one embodiment, a method for supplying a plurality of capacitance values to a plurality of heating, ventilation, air-conditioning, and refrigeration (HVAC/R) components is provided. The method includes configuring a first set of terminals of a connection device to couple a first capacitor to the connection device and configuring the connection device to couple the first capacitor to at least one of the plurality of HVAC/R components. The method further includes configuring a second set of terminals of the connection device to couple a second capacitor to the connection device and configuring the connection device to selectively couple the second capacitor to at least one of the plurality of HVAC/R components.

In another embodiment, a connection device for selectively coupling a plurality of capacitors to a plurality of components included in a heating, ventilation, air-conditioning, and refrigeration (HVAC/R) system is provided. The connection device includes a first conductor operable to couple a first contact of a first capacitor to a first HVAC/R component, a second conductor operable to couple a second contact of said first capacitor to a second HVAC/R component, and a third conductor operable to selectively couple a first contact of a second capacitor to one of said first HVAC/R component and said second HVAC/R component.

In another embodiment, a maintenance kit for servicing heating, ventilation, air-conditioning, and refrigeration (HVAC/R) systems, wherein the HVAC/R system includes a plurality of components, is provided. The kit includes a plurality of capacitors of varied ratings, the plurality of capacitors selected to provide predetermined capacitance values when coupled. The kit also includes a connection device configured to couple capacitors selected from the plurality of capacitors to at least one component of the HVAC/R system.

In another embodiment, a heating, ventilation, air-conditioning, and refrigeration (HVAC/R) condensing unit is provided. The HVAC/R condensing unit includes a compressor motor, a condensing fan motor, control circuitry configured to provide power to, and control operation of, the compressor motor and the condensing fan motor, and a connection device configured to couple the control circuitry, the compressor motor, and the condensing fan motor through at least one capacitor.

DETAILED DESCRIPTION OF THE INVENTION

Figure 1:
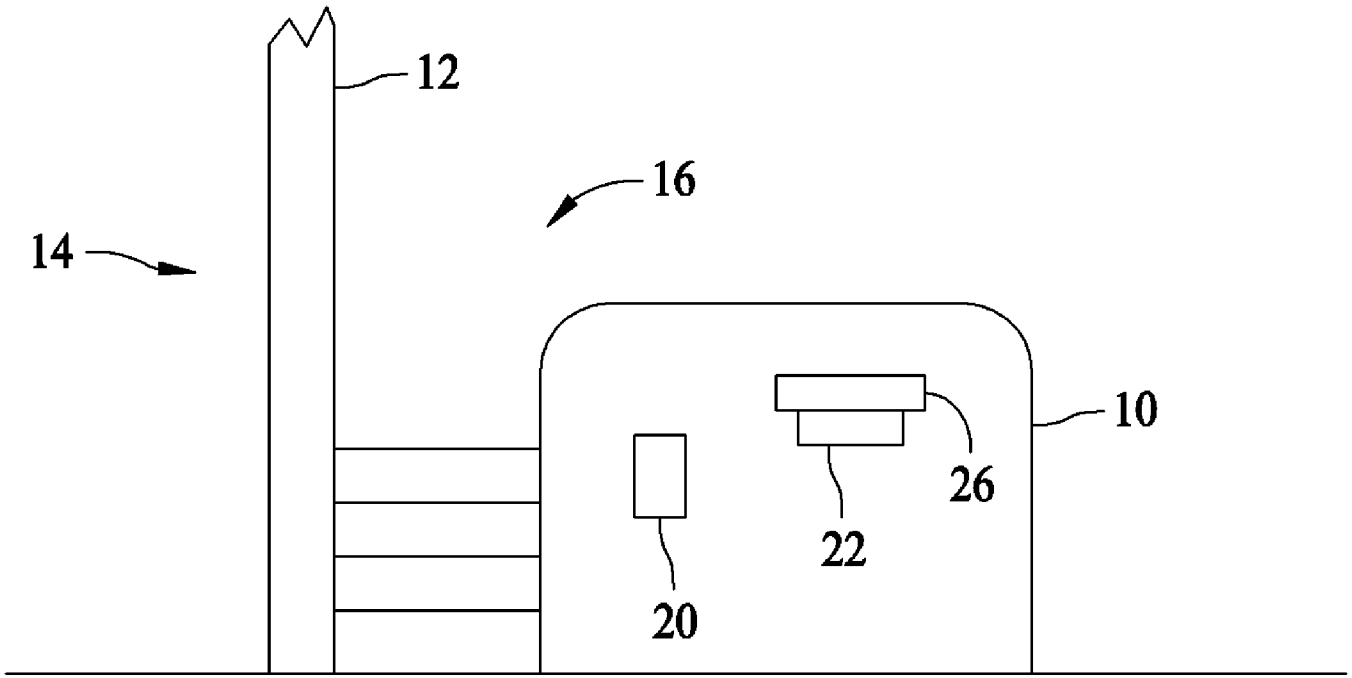
FIG. 1 (Prior Art)
FIG. 1 is a schematic block diagram of a condenser unit of a heating, ventilation, and air-conditioning (HVAC/R) system.

A residential heating, ventilation, air-conditioning, and refrigeration (HVAC/R) system typically includes a condenser unit, or air conditioning unit, positioned outside of a structure, (e.g., a house, a building, a warehouse, etc.) that is to be cooled. FIG. 1 is a block diagram of a known condenser unit 10 positioned adjacent to a structure 12 having an interior 14 and an exterior 16. One purpose of an HVAC/R system and condenser unit 10 is to control the climate of interior 14 of structure 12. Condenser unit 10 is positioned exterior 16 to structure 12.

Condenser unit 10 typically includes two electric motors. A compressor motor 20 and a condenser motor 22. Compressor motor 20 (also referred to as a hermetic unit) compresses a refrigerant, causing the temperature of the refrigerant to rise. The hot refrigerant gas is provided to a condenser coil 26. Condenser motor 22 turns an impeller (not shown in FIG. 1) to circulate air across the condenser coil 26, reducing the temperature of the refrigerant within the condenser coil 26.

Typically, both compressor motor 20 and condenser motor 22 require a capacitor (not shown in FIG. 1) for starting and/or running motors 20 and 22. Each motor may utilize a capacitor having a different capacitance value. An example of a type of capacitor used within HVAC/R systems is, but is not limited to, an AC film capacitor. Known condenser units 10 use dual capacitor units that provide two fixed capacitance values within one package. A large number of capacitors having a variety of different capacitance values are currently being used in condenser units 10 due to the large variety of condenser units 10 that are currently in use and each different condenser unit 10 may include different motors 20 and 22, depending on factors such as the size of the structure 12 to be cooled and the climate of the structure's 12 location. As described above, on-site service and maintenance of HVAC/R systems is complicated by the large number of different motors 20 and 22 being used in HVAC/R systems.

Figure 2:
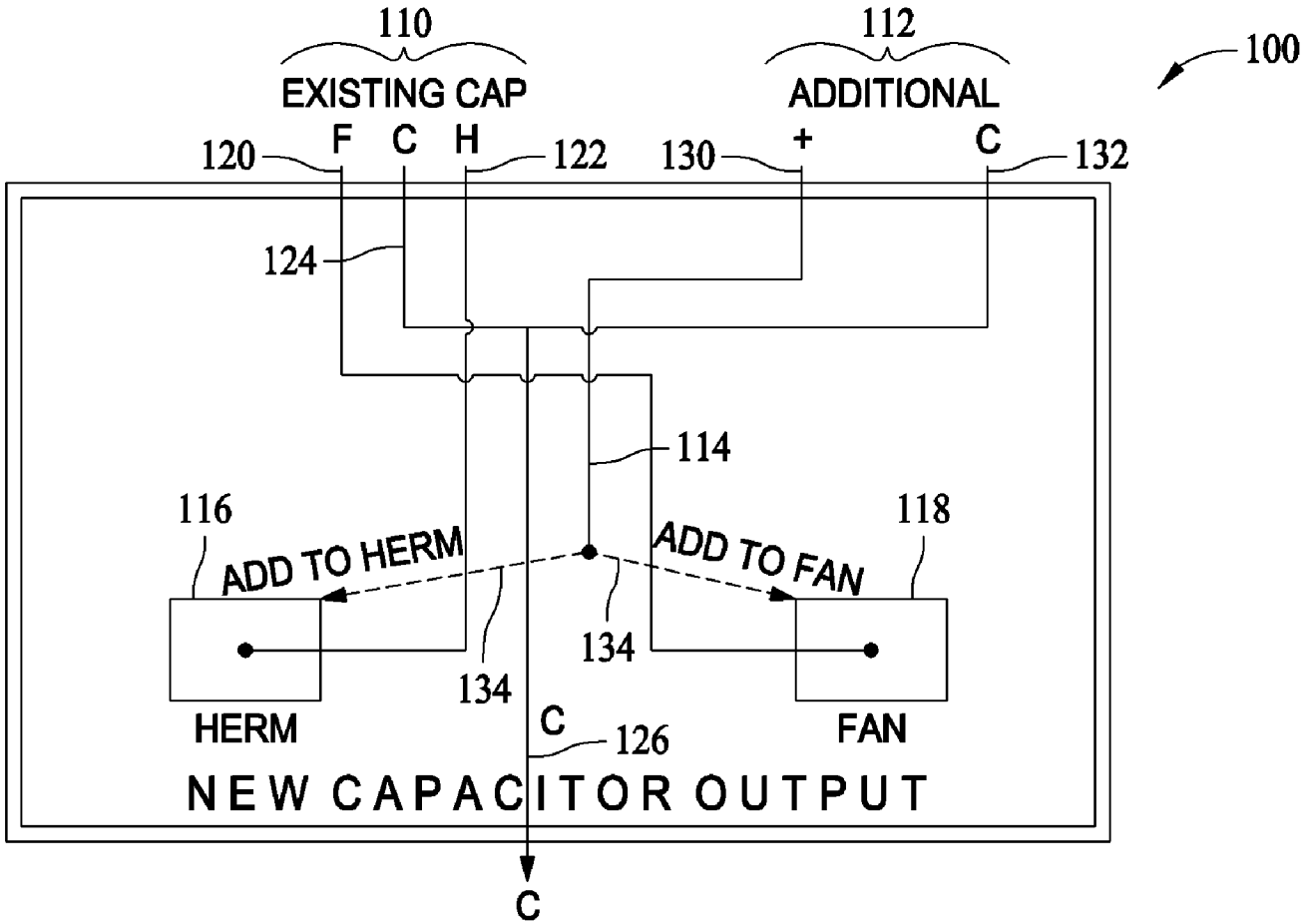
FIG. 2 is a circuit diagram of a capacitor connection device.

FIG. 2 is a circuit diagram of an exemplary capacitor connection device 100. Capacitor connection device 100 includes a first set of terminals 110, a second set of terminals 112, and a selection device 114. Capacitor connection device 100 also includes at least one output terminal, for example, a compressor motor connector 116 and a condenser motor connector 118. Compressor motor connector 116 and condenser motor connector 118 may each be a set of quick connect terminals of a standard configuration, and are used in the same manner as typical capacitor connectors.

In the exemplary embodiment, the first set of terminals 110 includes three terminals, a condenser motor terminal 120, a compressor motor terminal 122, and a common terminal 124. Condenser motor terminal 120 is electrically coupled to condenser motor connector 118. Compressor motor terminal 122 is electrically coupled to compressor motor connector 116. In use, a capacitor is coupled to connection device 100 through condenser motor terminal 120 and compressor motor terminal 122. In an exemplary embodiment, the three terminals of a dual-rated capacitor unit (not shown in FIG. 2) are coupled to connection device 100 through the first set of terminals 110. The dual-rated capacitor unit (not shown in FIG. 2) provides a first capacitance value to condenser motor terminal 120 and a second capacitance value to compressor motor terminal 122. In an alternative embodiment, multiple capacitors may be coupled to the first set of terminals 110, for example, one terminal of a first capacitor coupled to condenser motor terminal 120, one term of a second capacitor coupled to compressor motor terminal 122, and the common terminals of both the first and second capacitors coupled to common terminal 124.

The second set of terminals 112 includes two terminals, an additional capacitance value terminal 130 and a common terminal 132. In the exemplary embodiment, common terminal 132 is coupled to common terminal 124 and coupled to a ground voltage (not shown) by, for example, a wire 126. Additional capacitance value terminal 130 is coupled to selection device 114. Selection device 114 selectably couples additional capacitance value terminal 130 to either compressor motor terminal 122 or condenser motor terminal 120.

In the exemplary embodiment, selection device 114 is a flying lead wire that includes a quick disconnect terminal configured to couple either compressor motor connector 116 or condenser motor connector 118 to additional capacitance value terminal 130. In alternative embodiments, selection device 114 is a switch (not shown in FIG. 2) that selectively couples additional capacitance value terminal 130 to either compressor motor connector 116 or condenser motor connector 118. Other known switching devices may be used so long as the switching device allows connection device 100 to function as described herein.

Selection device 114 also includes an indication 134 as to which of compressor motor connector 116 and condenser motor connector 118 additional capacitance value terminal 130 is coupled. In one exemplary embodiment, selection device 114 is marked with the legend "ADD TO HERM" and "ADD TO FAN." Clear labeling ensures that a user of connection device 100 is certain where the additional capacitance value will be added.

Selection device 114 couples either compressor motor connector 116 or condenser motor connector 118 to additional capacitance value terminal 130 dependent upon a user's selection as to where additional capacitance is to be added. Compressor motor connector 116 and condenser motor connector 118 provide a connection to an air conditioning or refrigeration unit, for example, condenser unit 10. More specifically, compressor motor connector 116 accepts a connector commonly used to couple a compressor to a capacitor and condenser motor connector 118 accepts a connector commonly used to couple a condenser to a capacitor. In a specific embodiment, compressor motor connector 116 is a triple blade quick connect terminal and condenser motor connector 118 is a dual blade quick connect terminal, which are currently used to connect a capacitor to a compressor and a condenser.

Figure 3:
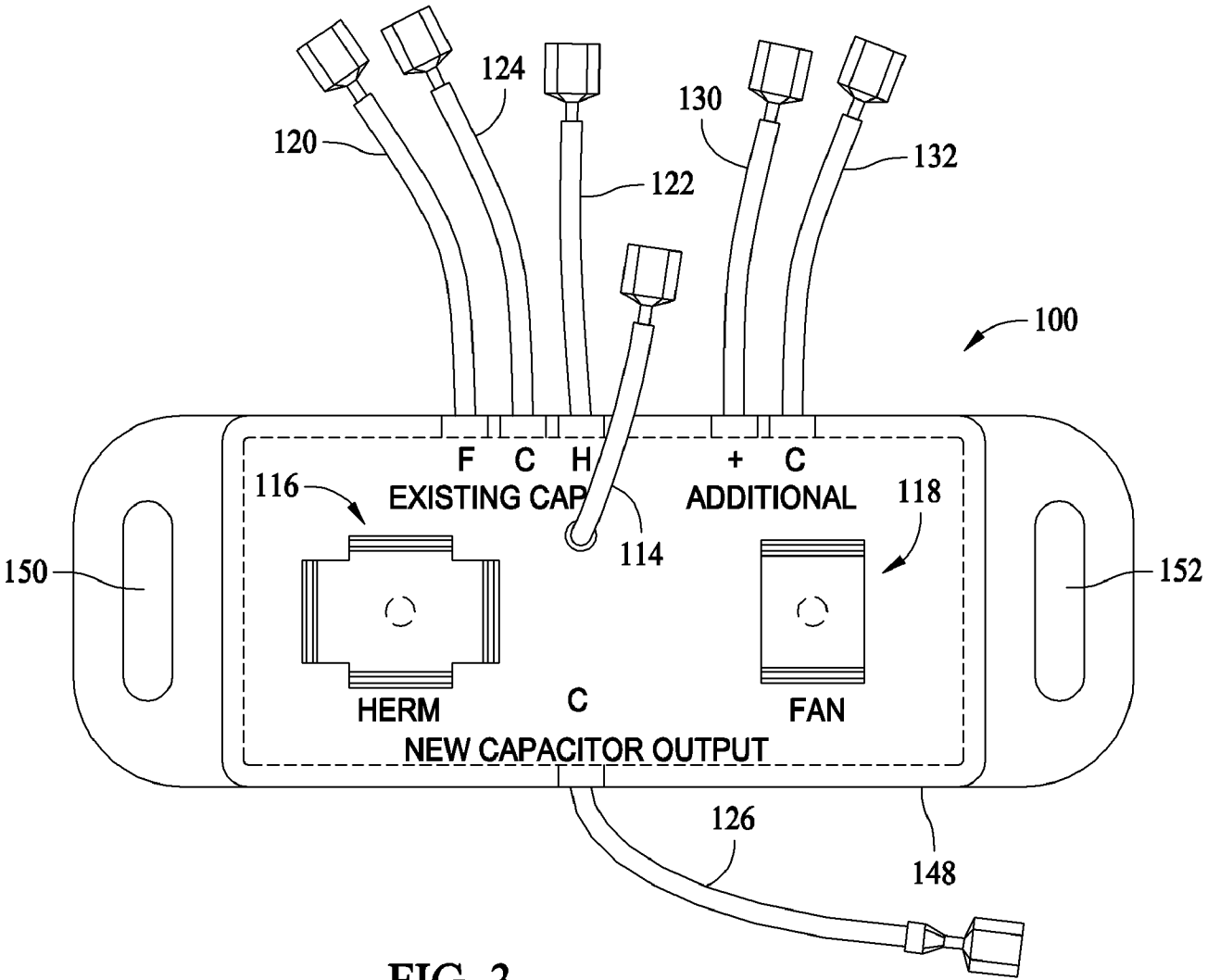
FIG. 3 is a top view of a capacitor connection device.
Figure 4:
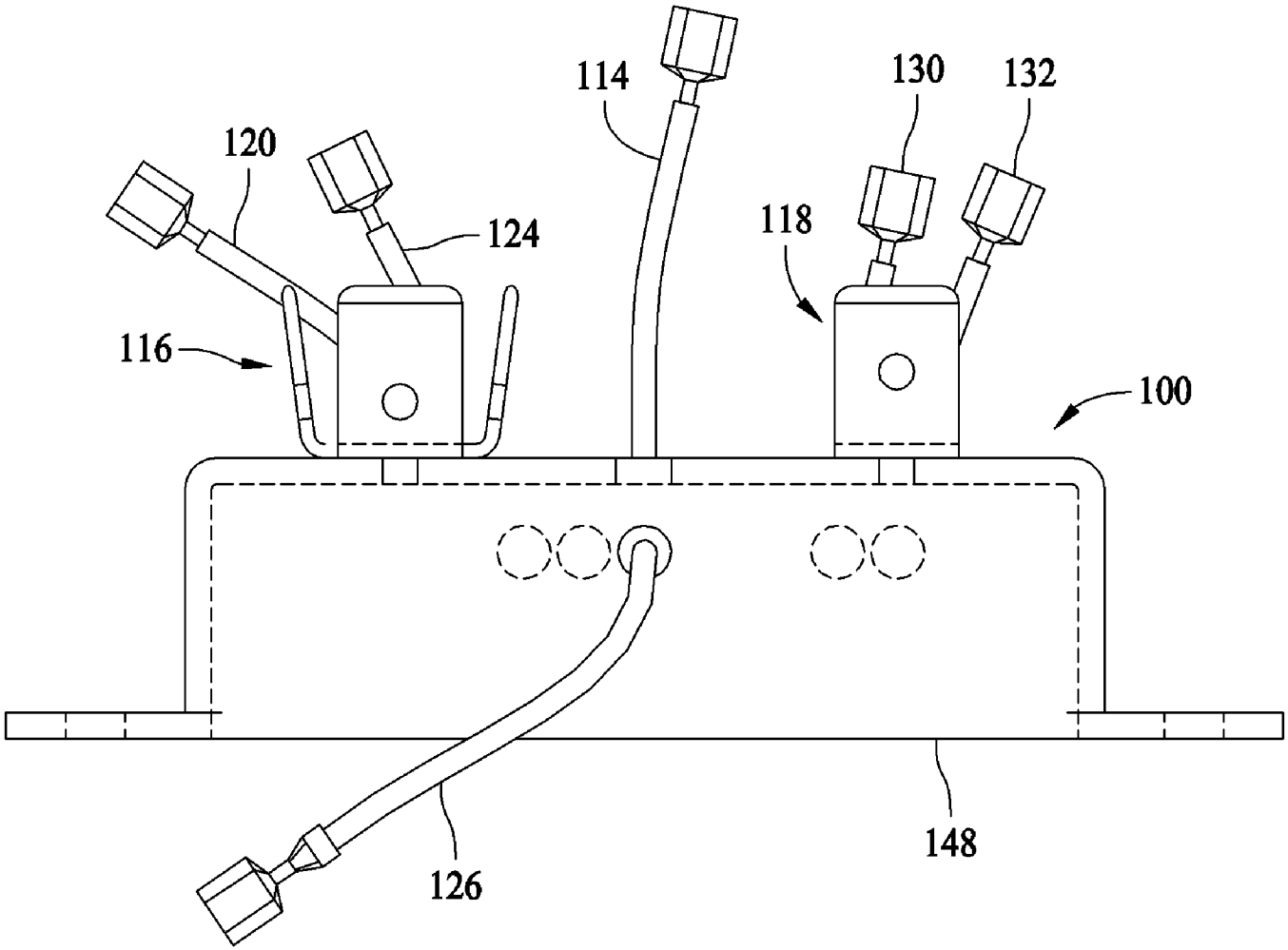
FIG. 4 is a side view of the capacitor connection device of FIG. 3.
Figure 5:
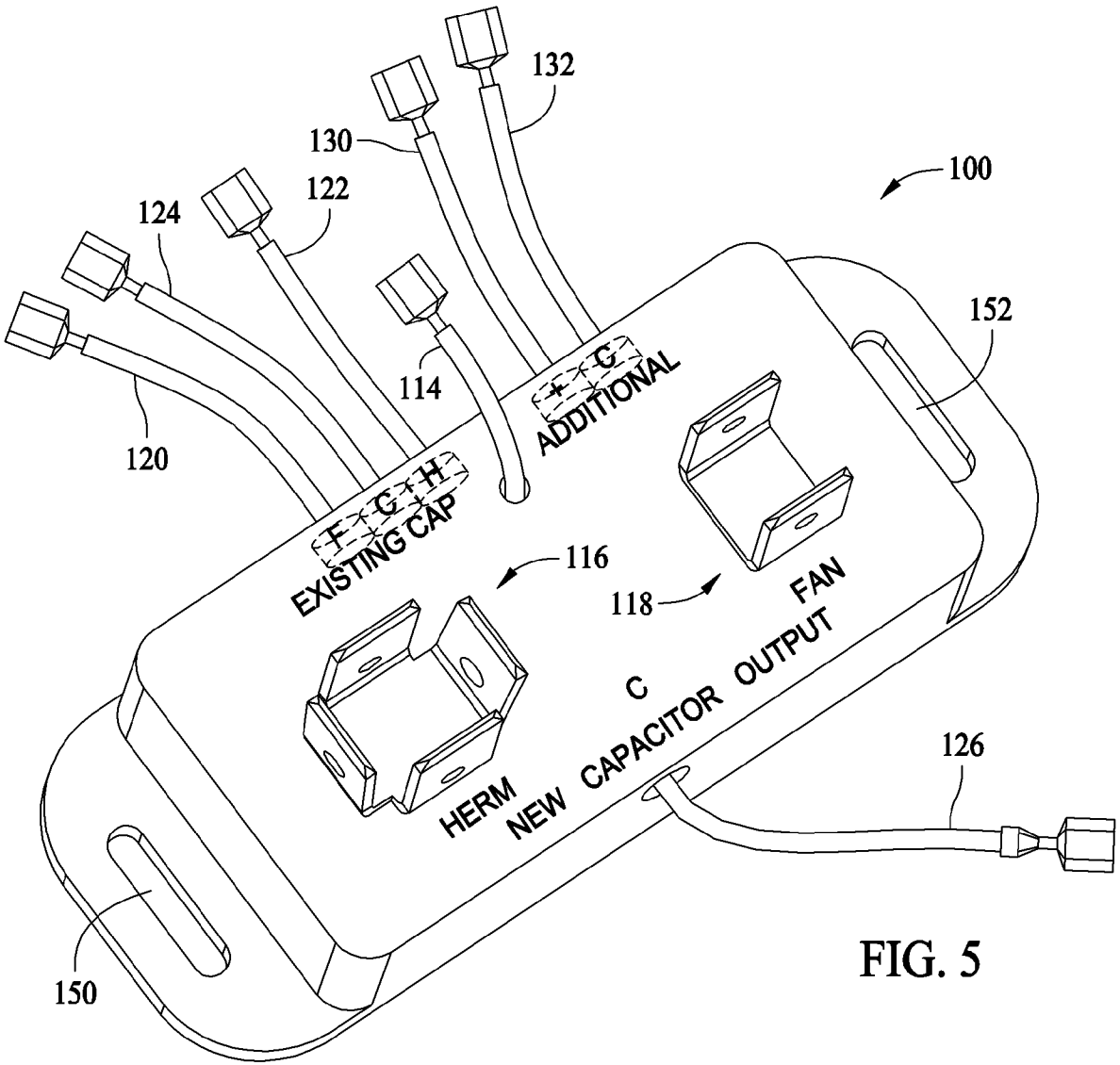
FIG. 5 is a perspective view of the exemplary capacitor connection device of FIGS. 3 and 4.

FIGS. 3-5 are multiple views of the exemplary embodiment of capacitor connection device 100. Components that are the same in FIG. 2 and FIGS. 3-5 are identified with the same reference numerals. In the embodiment of FIGS. 3-5, capacitor connection device 100 is enclosed within a plastic molded box 148 that includes the terminals described above. Connection device 100 is also provided with two mounting slots 150 and 152 that can be used to secure the connection device 100 to the HVAC/R unit. In alternative embodiments, any enclosure and associated mounting devices may utilized as long as capacitor connection device 100 is allowed to function as described herein.

Figure 6:
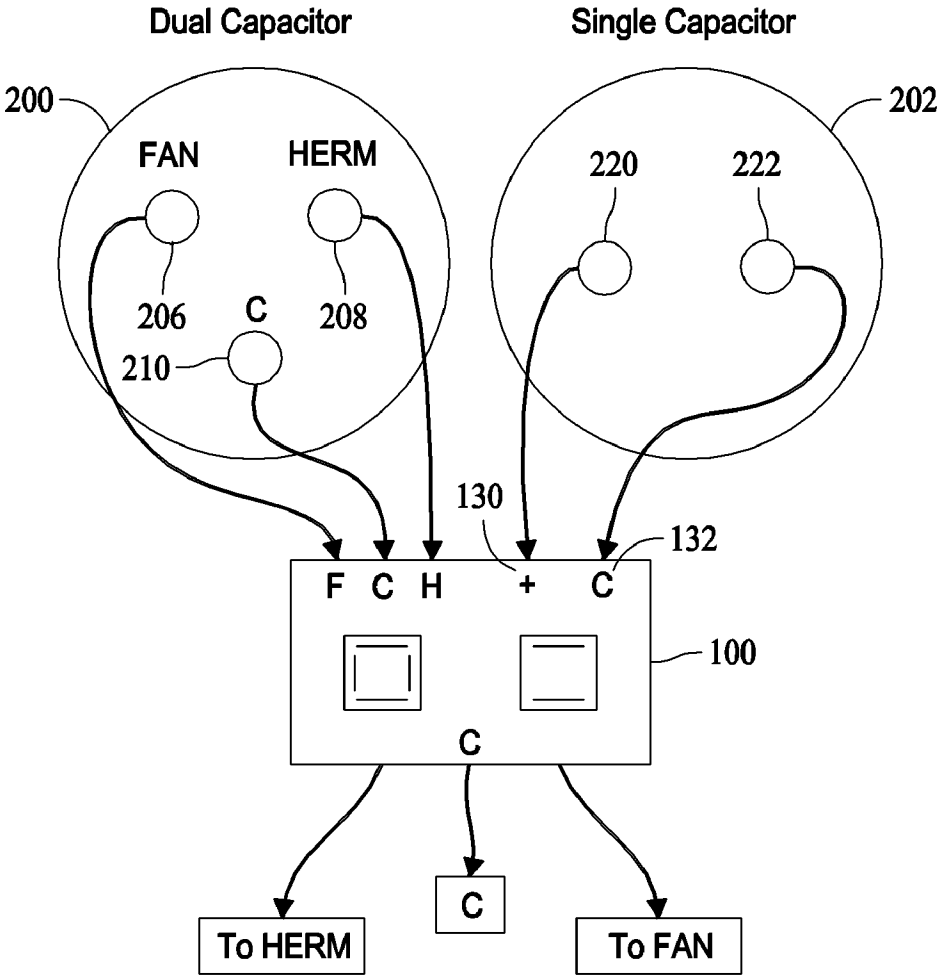
FIG. 6 is a diagram illustrating a connection of the exemplary capacitor connection device of FIGS. 3-5 to capacitors.

FIG. 6 is a diagram of a top view of capacitor connection device 100 coupled to a first capacitor 200 and a second capacitor 202. First capacitor 200 is a dual capacitor that, as described above, provides two capacitance values. In an exemplary embodiment, first capacitor 200 is a dual rated capacitor. Second capacitor 202 is a single capacitor, providing a single capacitance value.

The first capacitor 200 has three distinctive and well-identified terminals. A first terminal 206 is identified with the label "FAN" for where condensing motor 22 is connected; a second terminal 208 is identified with the label "HERM" for where the compressor motor 20, also referred to the Hermetic Unit, is connected; and a third terminal 210 identified with the letter "C" indicating a common terminal.

To utilize capacitor connection device 100, first terminal 206 of the first capacitor 200 is coupled to condenser motor terminal 120. Additionally, second terminal 208 of the first capacitor 200 is coupled to compressor motor terminal 122, and third terminal 210 of the first capacitor 200 is coupled to common terminal 124. Similarly, a first terminal 220 of second capacitor 202 is coupled to the additional capacitance value terminal 130 and a second terminal 222 of second capacitor 202 is coupled to common terminal 132.

Capacitor connection device 100 operated to interconnect capacitors having individual capacitance values, to create a single or dual rated capacitor with the one or two specific capacitance values needed for a particular application. In one common application, connection device 100 is utilized to create the capacitance values needed by a service or repair technician using a set of standard capacitors having specific capacitance values. This is accomplished by adding the desired additional capacitance to the capacitor section selected by choosing the clearly identified terminal of that particular capacitor section and by connecting the additional capacitance to be added to create the desired capacitance values. By obtaining the desired capacitance values through a combination of two or more capacitors, the number of capacitors that need to be taken to a service call at a remote site in order to ensure possession of the capacitance values needed for a repair is reduced.

Figure 7:
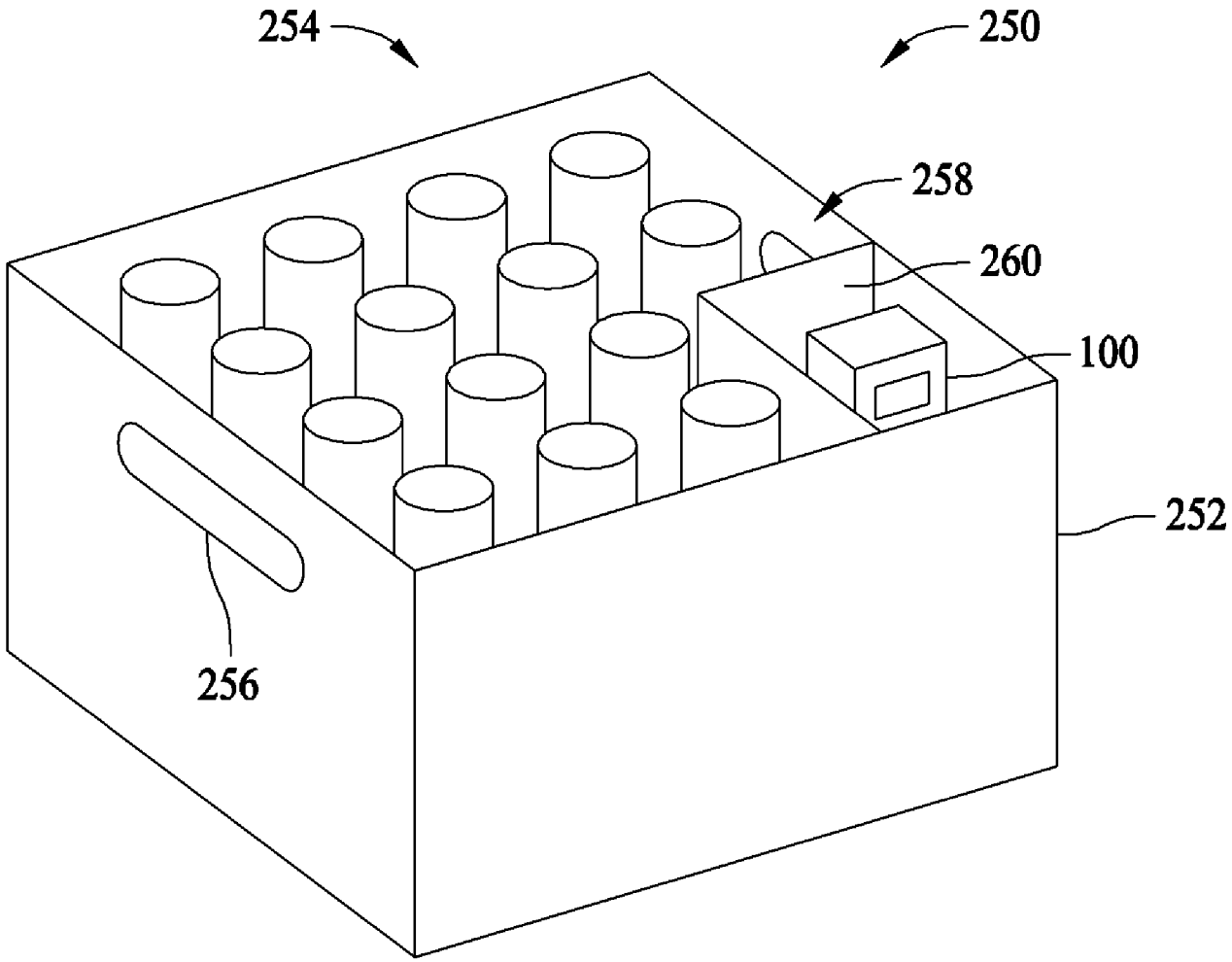
FIG. 7 is a view of an exemplary embodiment of a capacitor maintenance kit.

FIG. 7 is a perspective view of an exemplary capacitor maintenance kit 250. Capacitor maintenance kit 250 includes a storage case 252, a plurality of capacitors 254, and a capacitor connection device, which in an exemplary embodiment is connection device 100. Storage case 252 may include carrying handles 256 and 258 to facilitate carrying of capacitor maintenance kit 250. Storage case 252 may also include dividers, for example, divider 260, to separate each of the plurality of capacitors, and also separate connection device 100 from the plurality of capacitors. Divider 260 also enables a user to quickly identify a missing capacitor, and storage case 252 may also include indicia indicating the capacitance value of the capacitor designed to be held in each divided segment of storage case 252.

Table 1 is an exemplary list of capacitors and associated capacitance values that may make up the plurality of capacitors 254 included in one embodiment of capacitor maintenance kit 250.

TABLE 1

| Capacitor number | First Capacitance Value (uF) | Second Capacitance Value (uF) | VAC |
|---|---|---|---|
| 1 | 5 | — | 370/440 |
| 2 | 10 | — | 370/440 |
| 3 | 20 | — | 370/440 |
| 4 | 15 | 5 | 370/440 |
| 5 | 30 | 5 | 370/440 |
| 6 | 35 | 5 | 370/440 |
| 7 | 35 | 7.5 | 370/440 |
| 8 | 40 | 5 | 370/440 |
| 9 | 40 | 7.5 | 370/440 |
| 10 | 45 | 5 | 370/440 |
| 11 | 45 | 7.5 | 370/440 |
| 12 | 50 | 5 | 370/440 |
| 13 | 50 | 7.5 | 370/440 |
| 14 | 50 | 10 | 370/440 |

In this illustrated embodiment, of the fourteen capacitors, three are single capacitance value capacitors and eleven are dual capacitance value capacitors. When utilized with capacitor connection device 100, sixty-one capacitance value combinations are provided that may be used in an attempt to repair an HVAC/R system. Table 2 shows the capacitance value combinations that can be obtained using the fourteen capacitors and the connection device 100 of the capacitor maintenance kit 250.

The individual capacitors, the capacitance values, and the number of capacitors in capacitor maintenance kit 250 are examples only. Capacitor maintenance kit 250 may include any number of capacitors with capacitance values predetermined to best suit the needs of specific service technicians. Capacitor maintenance kit 250 may be stocked based on predictions of potentially necessary capacitance values based on commonly repaired systems. In the exemplary embodiment, capacitor maintenance kit 250 includes fourteen capacitors. Eleven of the capacitors selected for exemplary capacitor maintenance kit 250 are multi-capacitance capacitors and three are single capacitance value capacitors. From the fourteen capacitors, sixty-one output capacitance combinations can be obtained.

TABLE 2

| Capacitance Values (uF) | | | | | | |
|---|---|---|---|---|---|---|
| > 5 | | | | | | |
| > 10 | 10/5 | | | | | |
| > 15/0 | 15/5 | 15/10 | 15/15 | | | |
| > 20/0 | 20/5 | 20/10 | 20/15 | | | |
| > 25/0 | 25/5 | | | | | |
| > 30/0 | 30/5 | 30/10 | 30/15 | | | |
| > 30/0 | 35/5 | 35/7.5 | 35/10 | 35/12.5 | 35/15 | |
| > 40/0 | 40/5 | 40/7.5 | 40/10 | 40/12.5 | 40/15 | |
| > 45/0 | 45/5 | 45/7.5 | 45/10 | 45/12.5 | 45/15 | |
| > 50/0 | 50/5 | 50/7.5 | 50/10 | 50/12.5 | 50/15 | |
| > 55/0 | 55/5 | 55/7.5 | 55/10 | | | |
| > 60/0 | 60/5 | 60/7.5 | 60/10 | | | |
| > 65/0 | 65/5 | 65/7.5 | 65/10 | | | |
| > 70/0 | 70/5 | 70/7.5 | 70/10 | | | |
| > 80/0 | 80/5 | 80/7.5 | 80/10 | | | |

Notes:

1) Direct Usage of One Capacitor
2) Combination by using Two capacitors
3) Combination by using Herm Only
4) 11 Dual Caps + 3 Single Caps = 14 Caps
5) 61 total Output Ratings for both 370 and 440 voltages In one illustrative example, an HVAC/R unit being repaired requires a 30 uF compressor capacitor and a 15 uF condenser capacitor. In order to obtain this combination of capacitance values, capacitor number 5 (see Table 1) and capacitor number 1 (see Table 1) are connected to the HVAC/R unit through connection device 100. More specifically, the 30 uF terminal of capacitor number 5 is connected to the condenser motor terminal 120 of connection device 100. The 5 uF terminal of capacitor number 5 is connected to the compressor motor terminal 122. Capacitor number 1 is connected to additional capacitance terminal 130 and the common terminals of capacitor number 1 and capacitor number 5 are connected to common terminals 132 and 124, respectively. Selection device 114 is set to add the additional capacitance value to the condenser capacitor. The result is a 30 uF capacitor is provided to the compressor motor by capacitor number 5 and a 15 uF capacitor is provided to the condenser motor by a combination of capacitor number 1 and capacitor number 5.

As described herein, capacitor maintenance kit 250 and connection device 100 are configured to operate within a residential HVAC/R unit. However, capacitor maintenance kit 250 and connection device 100 are not limited to use in residential HVAC/R systems and may also be a benefit in commercial HVAC/R systems and also in residential or commercial refrigeration systems. Furthermore, connection device 100 is described herein as containing first set of terminals 110 and second set of terminals 112. However, connection device 100 may include any number of sets of terminals, configured to couple any number of individual capacitor units, and will couple the individual capacitor units in the same manner of coupling first set of terminals 110 to second set of terminals 112 that is described above.

The above-described methods and apparatus are cost-effective and reliable while still facilitating repair of an HVAC/R system, and more specifically, for replacement of HVAC/R unit capacitors. In addition, the combination of the connection device 100 and capacitor maintenance kit 250 provide the user the ability to use the connection device 100 to service a variety of HVAC/R units. Also, the kit enables a user to maintain a suitable inventory by placing an order for a replacement connection device 100 and the used-up capacitor units from the kit at a lower cost that buying an entire new replacement kit. Consequently, connection device 100 and capacitor maintenance kit 250 provide service personnel with the ability to create a broad arrange of capacitance values and combinations in a cost-effective manner.

While the invention has been described in terms of various specific embodiments, those skilled in the art will recognize that the invention can be practiced with modification within the spirit and scope of the claims.

What is claimed is:

1. A maintenance kit for servicing heating, ventilation, air-conditioning, and refrigeration (HVAC/R) systems, said HVAC/R system comprising a plurality of components, said kit comprising:

a plurality of capacitors of varied ratings, said plurality of capacitors selected to provide predetermined capacitance values when coupled to a component; and a connection device including a plurality of conductors configured to couple at least two capacitors selected from said plurality of capacitors to at least one component of said HVAC/R system.

2. A maintenance kit according to claim 1 wherein said plurality of capacitors comprises a first set of capacitors and a second set of capacitors, said first set of capacitors comprising dual-rated capacitor units of varied ratings, and said second set of capacitors comprising single rating capacitors of varied ratings.

3. A maintenance kit according to claim 2 wherein said connection device is configured to couple a capacitor from said first set of capacitors to at least one of said HVAC/R system components and selectively couple a capacitor from said second set of capacitors to at least one of said HVAC/R system components.

4. A maintenance kit according to claim 3 wherein said connection device comprises at least one of a switch and a jumper-wire configured to selectively couple a capacitor from said second set of capacitors to at least one of said HVAC/R system components.

* * * * *